United States Patent [19]

Emmerich

[11] Patent Number: 4,729,140

[45] Date of Patent: Mar. 8, 1988

[54] APPARATUS FOR PULLING THE LASTING EDGES OF LASTED SHOE UPPERS OVER INSOLES

[75] Inventor: Wolfgang Emmerich, Bad Münstereifel, Fed. Rep. of Germany

[73] Assignee: Maschinenfabrik Moenus-Turner GmbH, Oberursel, Fed. Rep. of Germany

[21] Appl. No.: 36,441

[22] Filed: Apr. 9, 1987

[30] Foreign Application Priority Data

Apr. 14, 1986 [DE] Fed. Rep. of Germany ... 8610141[U]

[51] Int. Cl.[4] ..... A43D 25/053

[52] U.S. Cl. ..... 12/8.3

[58] Field of Search ..... 12/8.3, 12, 7, 7.9, 12/8.1–8.4, 10.1, 10.7; 69/37, 40, 44; 464/51, 57, 58, 61, 81, 97, 183; 138/129, 134

[56] References Cited

U.S. PATENT DOCUMENTS

| | | | |
|---|---|---|---|
| 2,401,100 | 5/1946 | Pile | 464/58 |
| 2,551,546 | 5/1951 | Pile | 464/58 |
| 2,667,908 | 2/1954 | Kamborian | 12/8.3 |
| 2,709,268 | 5/1955 | Kamborian | 12/8.3 |
| 3,149,480 | 9/1964 | Hunt | 464/58 |
| 3,758,902 | 9/1973 | Gadd et al. | 12/8.3 |
| 3,828,385 | 8/1974 | Jancik et al. | 12/8.3 |
| 3,971,089 | 7/1976 | Gadd et al. | 12/8.3 |
| 4,149,391 | 4/1979 | Driver | 464/57 |

FOREIGN PATENT DOCUMENTS

| | | | |
|---|---|---|---|
| 0548770 | 4/1932 | Fed. Rep. of Germany | 464/58 |
| 2845303 | 3/1986 | Fed. Rep. of Germany . | |
| 0597914 | 2/1948 | United Kingdom | 464/52 |

*Primary Examiner*—Steven N. Meyers
*Attorney, Agent, or Firm*—Peter K. Kontler

[57] ABSTRACT

Apparatus for pulling the lasting edge of a lasted shoe upper over an insole has at least one flexible elastic shaft one end portion of which is anchored in a motor-driven rotor and which is loosely surrounded by a helical spring. One end of the spring is anchored in the rotor and its other end is movable axially of the shaft toward and away from the one end. The spring yields in response to the application of an excessive pull to the lasting edge and thus prevents overstressing of the lasting edge and/or the development of wrinkles.

20 Claims, 13 Drawing Figures

2
1
22
8
308
301
322
X 1
301

APPARATUS FOR PULLING THE LASTING EDGES OF LASTED SHOE UPPERS OVER INSOLES

BACKGROUND OF THE INVENTION

The invention relates to shoe machinery in general, and more particularly to improvements in apparatus for treating the lasting edges of shoe uppers. Still more particularly, the invention relates to improvements in apparatus for so-called pulling of lasting edges of lasted shoe uppers over insoles.

German Pat. No. 28 45 303 discloses an apparatus wherein the lasting edge of a lasted shoe upper is pulled over the insole by a pair of rigid frustoconical shafts having oppositely inclined integral screw threads. The shafts are driven to rotate in opposite directions whereby the screw threads pull the lasting edge over the insole which overlies the underside of the last for the shoe upper. The shafts are parallel to each other and are journalled in a bearing sleeve which is pivotable about an axis that is adjacent the median portions of the shafts and extends transversely of the shafts. The pivotability of the bearing sleeve is considered necessary in order to enable the shafts to be oriented in a manner such as to maintain their threads in engagement with the lasting edge, i.e., to conform their inclination to the inclination of the adjacent portion of the last.

A drawback of the patented apparatus and of other apparatus which for many decades employ rigid shafts with rigidly affixed or integral threads is that portions of the lasting edge are likely to be subjected to excessive stresses because the threads of the shaft or shafts do not bear against the lasting edge with a uniform force, either because the insole is curved or because the mounting and design of the shaft or shafts and their threads do not allow for accurate conformance of the threads to the lasting edge which overlies the insole.

OBJECTS AND SUMMARY OF THE INVENTION

An object of the invention is to provide a novel and improved apparatus which ensures that the lasting edge of a lasted shoe upper can be pulled over the insole without localized overstressing of the lasting edge Another object of the invention is to provide the apparatus with a novel and improved shaft and with a novel and improved thread around the shaft.

A further object of the invention is to provide an apparatus which can prevent the development of wrinkles during pulling of the lasting edge with a greater degree of reliability than heretofore known apparatus.

An additional object of the invention is to provide a simple and inexpensive apparatus which can be used with advantage in connection with the making of all kinds of footwear wherein the lasting edge of the lasted shoe upper must be pulled over an insole or an analogous part.

Still another object of the invention is to provide a shoe making machine which embodies the above outlined apparatus.

A further object of the invention is to provide an apparatus wherein a defective or otherwise unsatisfactory thread can be replaced with a fresh or more satisfactory thread with a minimum of effort and with little loss in time.

Another object of the invention is to provide an apparatus whose shaft or shafts render it possible to more accurately conform to the shape of the adjacent portion of a last than in heretofore known apparatus.

An additional object of the invention is to provide the apparatus with novel and improved means for mounting the drive for the shaft or shafts and the respective thread(s).

One feature of the present invention resides in the provision of an apparatus for pulling the lasting edges of lasted shoe uppers over insoles or like parts. The apparatus comprises at least one flexible elastic cylindrical or substantially frustoconical shaft, means for rotating one end portion of the shaft so that the shaft is mounted in what can be termed cantilever fashion, and at least one substantially helical thread which surrounds and shares rotary movements of the shaft. The thread is or can be elastic (it can be merely flexible without a pronounced elasticity); in accordance with a presently preferred embodiment of the invention, the thread is made of a length of springy metallic or plastic wire. The mounting of the thread is preferably such that the shaft and the thread are movable relative to each other, especially that the major part of the thread is movable axially of the shaft.

The shaft can comprise a bundle of elongated elastic components in the form of rods, bars, strips or the like, and such components can include shorter and longer components, depending upon whether or not the shaft should assume a substantially frustoconical shape, namely the shape of a cylinder having a plurality of sections with different diameters.

The means for rotating the shaft can comprise a rotor having an end face and a socket in the end face, and the one end portion of the shaft is non-rotatably received in the socket. Furthermore, the end face of the rotor can have a recess which is adjacent the socket and receives one end portion of the thread. The external surface of the thread can be provided with a plurality of grooves, and such grooves can form a helix whose lead deviates from the lead of the thread.

The means for rotating the shaft and the thread can be mounted in a bearing member (e.g., in an elongated sleeve-like or rod-like bearing member) which is preferably pivotable about the axis of a fulcrum that is spaced apart from the one end portion of the shaft and extends transversely of the axis of the shaft. Means can be provided for pivoting the bearing member (together with the rotating means, with the shaft and with the thread) about the axis of the fulcrum.

Another feature of the invention resides in the provision of an apparatus for pulling the lasting edges of lasted shoe uppers over insoles or like parts. The apparatus comprises a shaft which may or may not be elastic, means for rotating one end portion of the shaft, and at least one substantially helical thread having an end portion which receives torque from the rotating means (either directly or through the medium of the shaft) and helical convolutions which loosely surround the shaft (i.e., the convolutions of the thread are movable relative to the shaft, especially in the axial direction of the shaft). The shaft is or can be substantially cylindrical, and the thread can include one or more coil springs.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
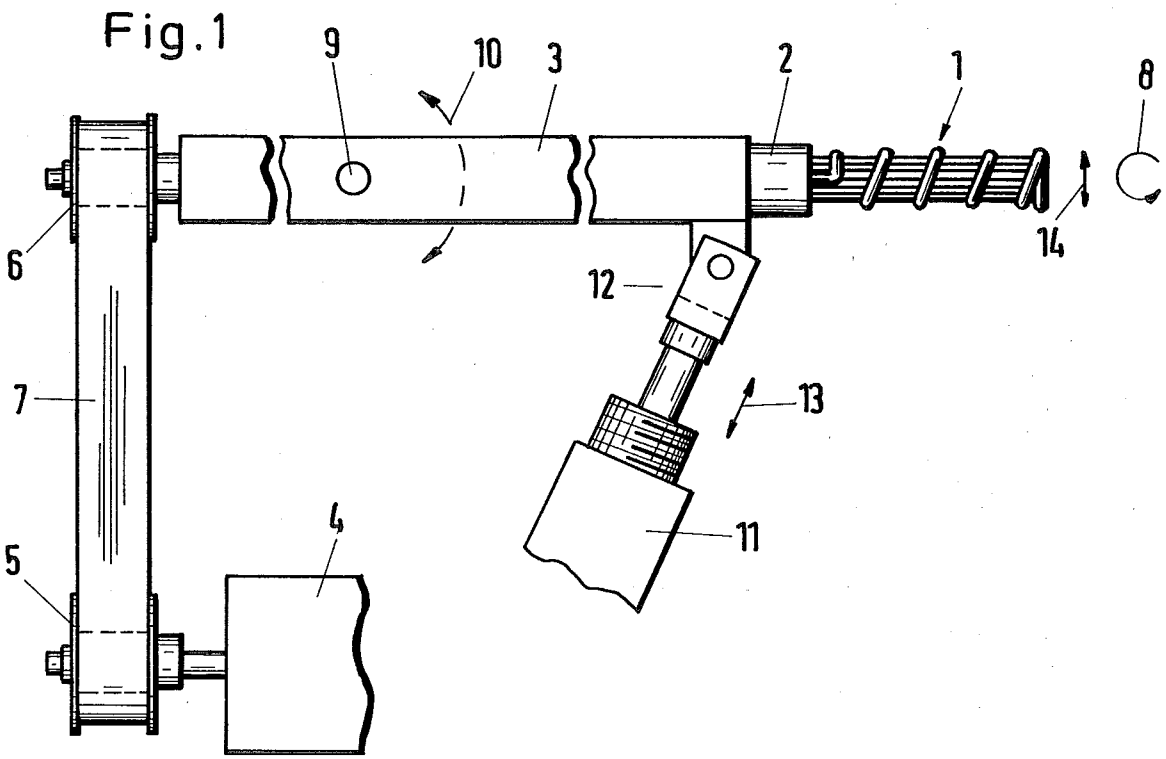
FIG. 1 is a fragmentary side elevational view of an apparatus which embodies one form of the invention and employs a single shaft.
Figure 2:
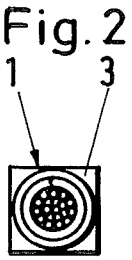
FIG. 2 is a front elevational view of the shaft, of the thread and of the bearing member for the means for rotating the shaft as seen from the right-hand side of FIG. 1.

FIGS. 1 and 2 show an apparatus which can be used to pull the lasting edge 17, 18 (FIGS. 3–4) of a shoe upper 16 over an insole 19 while the upper 16 is mounted on a last 15. The apparatus comprises a screw-like tool 1 which is driven by rotating means including a rotor 2. The latter is rotatably journalled in an elongated bearing member 3. The rotor 2 receives torque from a motor 4 through the medium of a transmission including a first pulley 5 on the output element of the motor 4, a second pulley 6 on the rotor 2 and an endless (toothed or toothless) belt 7 which is trained over the pulleys 5 and 6. The direction in which the tool 1 is rotated is indicated by arrow 8. The bearing member 3 is pivotable about the axis of a fulcrum 9 which is remote from the tool 1, i.e., from that end portion of the core or shaft 21 (see FIGS. 5–7) of the tool 1 which is non-rotatably secured to the rotor 2. The axis of the fulcrum 9 extends at right angles to the axis of the rotor 2, and the means for pivoting the bearing member 3 about the axis of the fulcrum in directions indicated by a double-headed arrow 10 comprises a fluid-operated cylinder and piston unit 11 whose piston rod 12 is articulately connected to the bearing member 3 close to the tool 1 and is reciprocable with reference to the cylinder in directions indicated by a double-headed arrow 13. Thus, the tool 1 can perform a rotary movement in the direction of arrow 8 as well as a rocking movement in directions indicated by a double-headed arrow 14.

Figure 3:
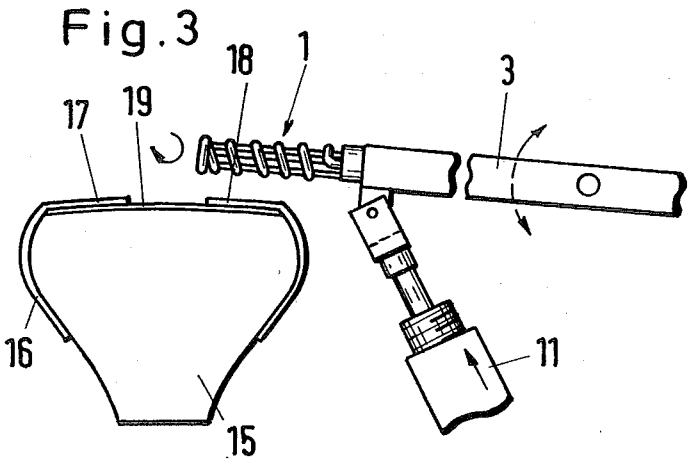
FIG. 3 is a smaller-scale fragmentary side elevational view of the apparatus and a schematic view of a lasted shoe upper whose lasting edge is about to be pulled by the shaft and its thread.

FIG. 3 shows the apparatus of FIGS. 1–2 in a position of readiness for pulling the lasting edge 17, 18 of the lasted shoe upper 16 over the insole 19. The arrangement is normally such that the last 15 maintains the upper 16 in inverted position and the apparatus is used to treat the edge 17, 18 from above.

Figure 4:
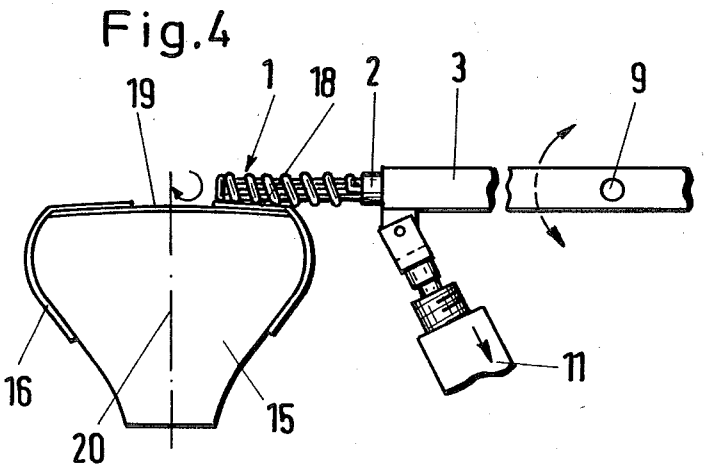
FIG. 4 shows the structure of FIG. 3 with the shaft and thread in pulling engagement with the lasting edge.

In FIG. 4, the tool 1 is in actual engagement with the edge 17, 18 and the thread 22 around its shaft 21 pulls the portion 18 of the lasting edge in a direction to the left i.e., toward the central longitudinal symmetry plane 20 of the last 15. The apparatus including the tool 1 is moved longitudinally of the last 15 (i.e., at right angles to the plane of FIG. 4) to treat the entire lasting edge of the upper 16. At the same time, the tool 1 can conform to the inclination of the adjacent portion of the last 15 so as to effectively pull the respective portion of the lasting edge.

Figure 5:
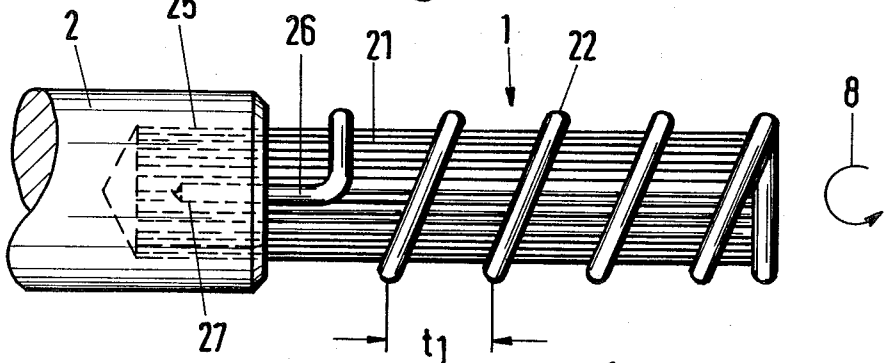
FIG. 5 is an enlarged side elevational view of the shaft and thread, showing the manner in which the shaft and thread are connected to the rotating means.
Figure 6:
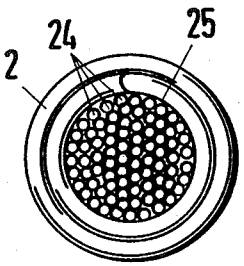
FIG. 6 is an end elevational view as seen from the right-hand side of FIG. 5.

As shown in FIGS. 5 and 6, the tool 1 comprises the cylindrical core or shaft 21 and the thread 22 which is a length of springy metallic or plastic wire whose convolutions loosely surround the shaft 21. The thread 22 is actually a coil spring one end portion 26 of which is parallel to the axis of the shaft 21 and extends into a recess 27 (e.g., a blind bore) in the adjacent end face of the rotor 2. The adjacent portion of the end face of the rotor 2 has a centrally located socket 25 for the respective end portion of the shaft 21. The latter is flexible in the radial direction relative to the end portion which is anchored in the socket 25 of the rotor 2 so that the shaft and the thread 22 therearound can readily follow the outline of the adjacent portion of the lasting edge 17, 18 when the tool 1 is in actual use in a manner as shown in FIG. 4. The shaft 21 of FIGS. 5 and 6 is made of a bundle of elongated rod-or bar-shaped components 24 which are anchored in the socket 25 and are secured therein by welding, by soldering or by another suitable procedure. The recess or bore 27 for the end portion 26 of the thread 22 is eccentric, i.e., it is parallel to the axis of the rotor 2. The manner in which the end portion 26 of the thread 22 is permanently or separably fixed to the rotor 2 is not specifically shown; this can be carried out by soldering, by ensuring that the end portion is a press fit in the recess 26 or in any other suitable way.

When the apparatus of FIGS. 1 to 6 is moved to the position of readiness which is shown in FIG. 3, the motor 4 is started to rotate the rotor 2 and hence the shaft 21 and the thread 22 before the tool 1 is lowered into pulling engagement with the lasting edge 17, 18 of the upper 16 on the last 15. The tool 1 is pressed downwardly so that the shaft 21 is flexed to a desired extent in order to ensure that several convolutions of the helical thread 22 are maintained in contact with the lasting edge in spite of the fact that the adjacent portion of the last 15 is curved and in spite of the fact that the bearing member 3 for the rotor 2 is pivotable about a single axis (of the fulcrum 9). The lasting edge is subjected to a uniform pull and is highly unlikely to be overstressed to an extent which would result in undue weakening and/or in the development of wrinkles. The convolutions of the thread 22 pull the adjacent portion of the lasting edge toward the symmetry plane 20 of the last 15.

Figure 7:
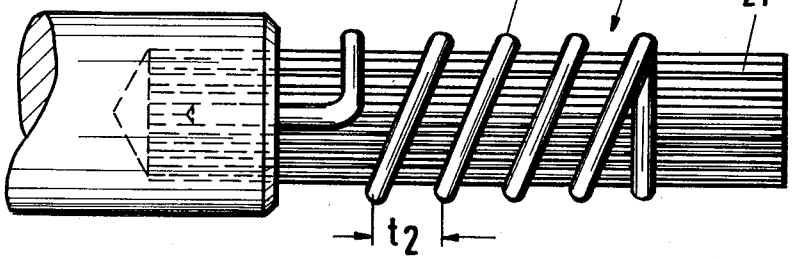
FIG. 7 shows the structure of FIG. 5 with a different thread or with the thread of FIG. 5 in axially compressed condition.

If the force with which the lasting edge is pulled toward the symmetry plane 20 is excessive, the convolutions of the thread 22 simply move relative to the shaft 21 in a direction toward the rotor 22, i.e., the original lead or pitch $t_1$ is reduced, for example, to the value $t_2$ which is shown in FIG. 7, as a result of movement of the free end portion of the thread 22 toward the end portion 26. Due to such change in pitch or thread, the pull which is exerted by the thread 22 is reduced, i.e., the lasting edge is subjected to a reduced stress and is highly unlikely to be unduly weakened and/or wrinkled.

The elastic shaft 21 allows for a much more uniform application of pull to the lasting edge than a rigid shaft.

The thread 22 can be integral with the shaft 21, i.e., it is also within the purview of the invention to use an elastic shaft and a thread which is non-movably connected to or made integral with the shaft. The making of a discrete thread (e.g., a length of coil spring) simplifies the making of the tool 1 and contributes to lower cost. Moreover, the ability of the thread to move its convolutions relative to the shaft brings about the aforediscussed advantages as concerns the uniformity of pull upon the lasting edge. Still further, by making the thread 22 as a separate part, the manufacturer can select the elasticity of the thread independently of that of the shaft 21. The thread 22 does not interfere with the flexibility of the shaft 21, and the shaft does not interfere with axial movability of one end portion of the thread, if these parts are made separately and are assembled in a manner as shown in FIGS. 5 to 7, i.e., so that the convolutions of the thread loosely surround the shaft (the term "loosely" is intended to denote that the convolutions of the thread are not soldered or otherwise more or less permanently connected to the shaft but the convolutions can be in frictional engagement with the external surface of the shaft).

Figure 8:
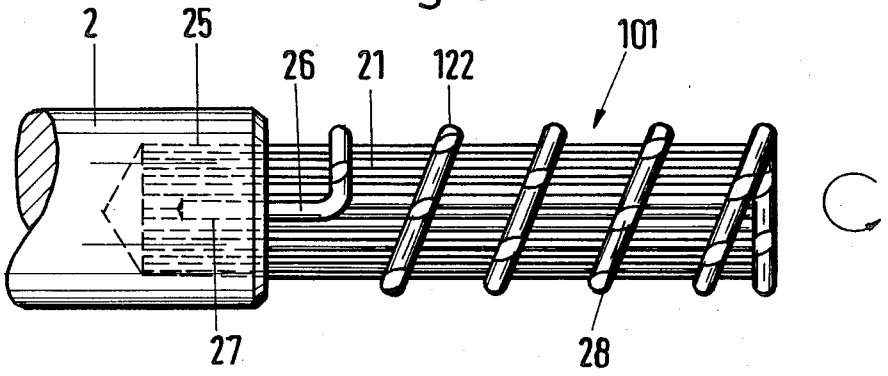
FIG. 8 is a fragmentary side elevational view of a second apparatus with a modified thread.
Figure 9:
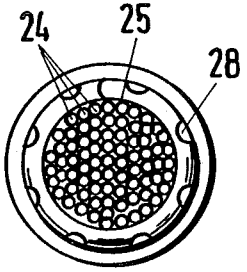
FIG. 9 is an end elevational view as seen from the right-hand side of FIG. 8.

FIGS. 8 and 9 show a portion of a modified apparatus wherein all such parts which are identical with the corresponding parts of the apparatus of FIGS. 1 to 7 are denoted by similar reference characters and the parts which are analogous to the aforedescribed parts of the first apparatus are denoted by similar reference characters plus 100. The main difference between the two apparatus is that the thread 122 forming part of the tool 101 of the apparatus of FIGS. 9 and 9 has a peripheral surface which is formed with a plurality of grooves or notches 28 (such notches can be formed by grinding or in any other suitable way) which interrupt the cylindrical peripheral surface of the thread at a plurality of locations (preferably at predetermined identical intervals) to thus allow for repeated shortlasting relaxation of stresses upon the lasting edge when the apparatus of FIGS. 8 and 9 is in actual use. This has been found to even further reduce the likelihood of wrinkling of the lasting edge and/or of the insole. The notches 28 together form a helix whose pitch or lead is greater than that of the thread 122. This ensures that the notches 28 do not engage the lasting edge simultaneously but rather at timely spaced intervals to thereby even further reduce the likelihood of overstressing and/or wrinkling of the lasting edge. In addition, overstressing of the lasting edge is prevented in the same way as described in connection with the apparatus of FIGS. 1 to 7, i.e., the pitch or lead of the thread 122 is reduced in that the free end portion of the thread moves nearer toward the end portion 26.

Figure 10:
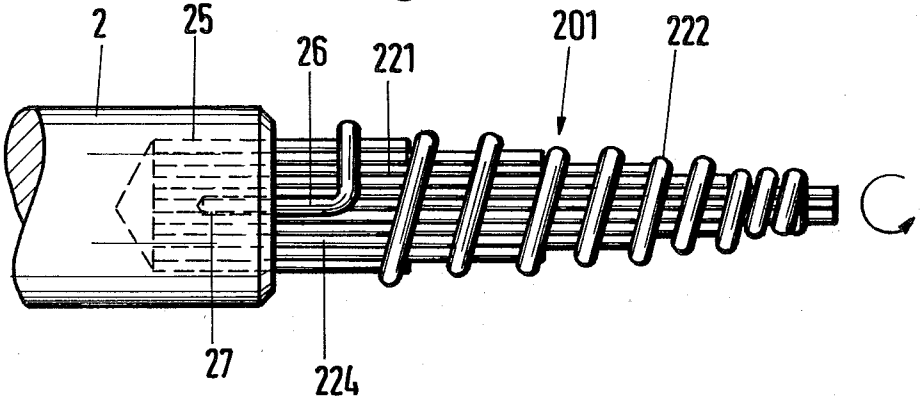
FIG. 10 is a side elevational view of a portion of a third apparatus which employs a substantially frustoconical shaft and a thread whose diameter decreases in a direction toward the free end of the shaft.
Figure 11:
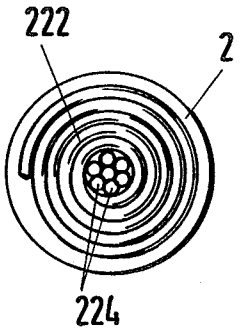
FIG. 11 is an end elevational view as seen from the right-hand side of FIG. 10.

FIGS. 10 and 11 illustrate a third apparatus having a tool 201 with a substantially conical or frustoconical shaft or core 221 and a helical thread 222 whose diameter decreases in a direction from the rotor 2 toward the free end of the sahft 221. The conicity or substantial conicity of the shaft 221 is attributable to the fact that it comprises five sets of elongated flexible elastic components 224 of different lengths. The longest components 224 form the central core of the shaft 221, the somewhat shorter components form an annulus which surrounds the major part of the core, the somewhat shorter components form a second annulus, and so forth. The left-hand end portions (as seen in FIG. 10) of all components 224 are anchored in the socket 25 of the rotor 2. It can be said that the shaft 221 includes five axially aligned portions or sections including a maximum-diameter section adjacent the rotor 2 and a minimum-diameter section at the free end of the shaft.

The extent to which the length of the thread 222 can be reduced in view of the just described configuration of the shaft 221, i.e., each portion of the helical thread is movable axially along the respective cylindrical section of the shaft. As a rule, such axial movability of the thread 222 suffices to prevent overstressing of the lasting edge. An advantage of the shaft 221 is that its flexibility increases in a direction from the socket 25 toward its free end which renders it even more likely that the shaft will maintain a large number of convolutions of the thread 222 in pulling engagement with the lasting edge.

An advantage of a shaft which is assembled of a plurality of elastic components 24 or 224 is that contributes to flexibility of the shaft because the moment of inertia which is important for the elastic line does not depend on the large cross-sectional area of the entire shaft but rather on the sum of smaller cross-sectional areas of the components 24 or 224.

Figure 12:
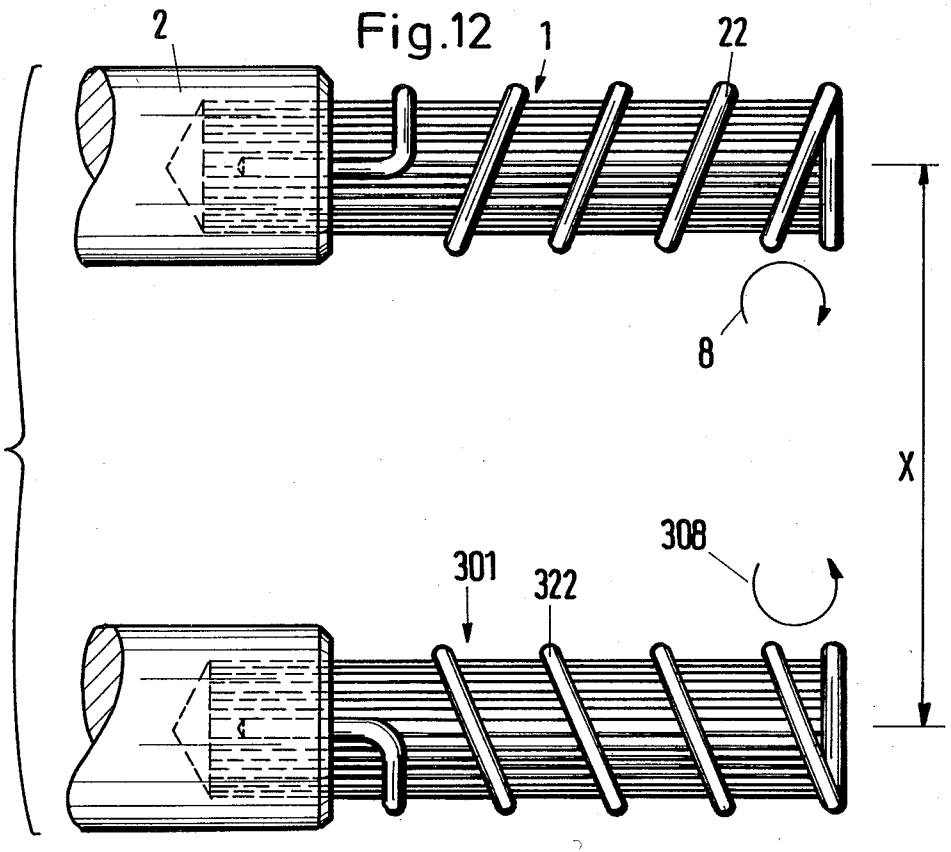
FIG. 12 is a fragmentary side elevational view of a further apparatus which employs two shafts.
Figure 13:
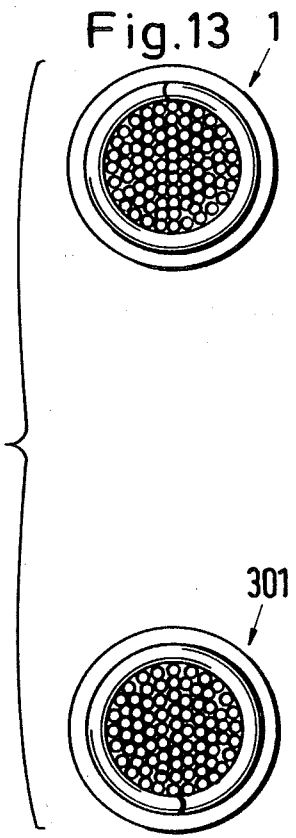
FIG. 13 is an end elevational view as seen from the right-hand side of FIG. 12.

FIGS. 12 and 13 show a portion of a fourth apparatus with two tools 1, 301. The tool 1 and its mounting are identical with those described in connection with FIGS. 1 to 7. The tool 301 has a shaft which is identical with the shaft of the tool 1 and a thread 322 whose convolutions are inclined counter to the inclination of the convolutions of thread 22 around the shaft of the tool 1. In addition, the means for rotating the tool 301 is designed to drive the respective shaft in the direction which is indicated by arrow 308, i.e., counter to the direction of rotation (arrow 8) of the tool 1. This can be achieved in a manner as disclosed in the aforementioned German Pat. No. 28 45 303, i.e., by mounting mating gears on the rotors for the shafts of the tools 1 and 301. The axes of the tools 1 and 301 are parallel to each other and their mutual spacing is shown at X.

Each embodiment of the improved apparatus can employ one or more tools with two or more threads and hence with a correspondingly reduced lead.

The thickness of components 24 or 224 of the shaft of the tool 1, 101, 201 or 301 need not be the same, i.e., the shaft can be assembled of thicker and thinner components as well as of components which have identical cross sectional areas but different flexibilities. The material of all components may but need not be the same. This depends on the circumstances of use and enables the maker to form tools which exhibit a desired degree of flexibility, either along the full length of the shaft or shafts or along selected portions of the shaft or shafts. Elastomeric plastic (nonmetallic) material can be used in lieu of or jointly with springy metallic material, such as spring steel. It is further possible to make a flexible shaft from a length of convoluted metallic or plastic wire, and such flexible shaft can have a hollow core.

The improved apparatus can be used in connection with the making of all kinds of footwear including shoes wherein the lasting edge is tacked or cemented to the insole. The elasticity of the shaft or shafts and of the thread or threads will be selected in dependency on the nature of the material of the lasting edge, on the shape of the last and/or on the desired extent of pull upon the lasting edge. Moreover, the pitch or lead of the thread or threads need not be constant, i.e., the thread can have a progressive or degressive lead in a direction from the anchored end portion toward the free end portion of the respective shaft. Still further, the axis of the shaft or the axes of the shafts need not be exactly normal to the plane 20 of the last. In addition, the axes of plural shafts need not be parallel but can cross each other. All in all, the improved apparatus can be put to use as a superior substitute for all kinds of heretofore known and used apparatus which employ one or more rigid shafts and threads which are not movable relative to the respective shafts.

It has been found that the provision of a single fulcrum 9 for the bearing member 3 at a location which is nearer to the anchored than to the free end of the shaft suffices to ensure adequate movability of the tool in actual use. The placing of the articulate connection between the pivoting means 11–12 and the bearing member intermediate the fulcrum 9 and the anchored end portion of the shaft has been found to allow for convenient manipulation of the tool.

As mentioned above, it is within the purview of the invention to employ a flexible shaft with a thread which is integral with or is rigidly connected to the shaft so that its convolutions cannot move toward or away from the anchored end portion of the shaft. It is also within the purview of the invention to employ a rigid or substantially rigid (non-elastic and non-flexible) shaft in conjunction with a thread which rotates with the shaft and whose convolutions are movable toward and away from the anchored end portion of the shaft. It is presently preferred to use a cylindrical shaft if the shaft is rigid because this enables the convolutions of the thread to move through a greater distance in the axial direction of the shaft. A thread whose convolutions are not affixed to the shaft can yield in response to a highly pronounced or excessive resistance of the lasting edge regardless of whether the lasting edge is engaged by a single convolution or by two or more convolutions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a lasting machine having means for pulling the lasting edges of a shoe upper over an insole while said upper is mounted on a last, the improvement comprising:

said means for pulling including at least one flexible elastic shaft having first and second end portions; means for rotating the first end portion of said shaft; and at least one substantially helical thread surrounding and rotatable with said shaft.

2. The apparatus of claim 1, wherein said thread is elastic.

3. The apparatus of claim 2, wherein the thread includes a length of springy wire.

4. The apparatus of claim 1, wherein the thread and the shaft are movable relative to each other.

5. The apparatus of claim 1, wherein said shaft comprises a bundle of elongated elastic components.

6. The apparatus of claim 5, wherein said components include shorter and longer components.

7. The apparatus of claim 1, wherein said rotating means comprises a rotor having an end face and a socket in said end face, said first end portion of said shaft being installed in said socket.

8. The apparatus of claim 7, wherein said end face has a recess adjacent said socket and said thread has an end portion anchored in said recess.

9. The apparatus of claim 1, wherein said thread has an external surface and a plurality of grooves in said surface.

10. The apparatus of claim 9, wherein said thread has a first lead and said grooves together form a helix having a different second lead.

11. The apparatus of claim 1, further comprising a bearing member for said rotating means, a fulcrum for said bearing member, said fulcrum being remote from the first end portion of said shaft, and means for pivoting said bearing member, said rotating means, said shaft and said thread about the axis of said fulcrum.

12. In a lasting machine having means for pulling the lasting edges of a shoe upper over an insole while said upper is mounted on a last, the improvement comprising:

said means for pulling including a shaft having first and second end portions; means for rotating the first end portion of said shaft; and at least one substantially helical thread having an end portion which receives torque from said rotating means and said thread further having helical convolutions loosely surrounding said shaft.

13. The apparatus of claim 12, wherein said shaft is substantially cylindrical and said thread includes a coil spring.

14. The apparatus of claim 12, wherein said shaft is substantially conical and the diameter of said helical convolutions decreases in a direction away from the first end portion of said shaft.

15. The apparatus of claim 12, further comprising a second shaft, means for rotating said second shaft, and a second helical thread having an end portion which receives torque from said second rotating means and said second helical thread further having helical convolutions loosely surrounding said second shaft.

16. The apparatus of claim 15, wherein said rotating means include means for rotating the first and second shafts in opposite directions, the inclination of convolutions of one of said first or second threads being counter to the inclination of convolutions of the other of said threads.

17. The apparatus of claim 12, wherein said shaft and/or said thread contains a springy metallic material.

18. The apparatus of claim 12, wherein said shaft is elastic and its elasticity varies in a direction from said first toward said second end portion thereof.

19. The apparatus of claim 12, wherein said thread has a second end portion which is movable toward and away from the torque-receiving end portion.

20. The apparatus of claim 12, further comprising means for pivoting said rotor and said shaft about an axis which is nearer the first than the second end portion of said shaft.

* * * * *